US008956126B2

(12) United States Patent
Fleischmann et al.

(10) Patent No.: US 8,956,126 B2
(45) Date of Patent: Feb. 17, 2015

(54) AUXILIARY SUMP WATER EVACUATION SYSTEM

(71) Applicant: Harry Lewis Sernaker, Washington, DC (US)

(72) Inventors: Lewis Werner Fleischmann, Pikesville, MD (US); Carle Daniel Klupt, Pikesville, MD (US)

( * ) Notice: Subject to any disclaimer, the term of this patent is extended or adjusted under 35 U.S.C. 154(b) by 0 days.

(21) Appl. No.: 13/671,519

(22) Filed: Nov. 7, 2012

(65) Prior Publication Data

US 2013/0115106 A1 May 9, 2013

Related U.S. Application Data

(60) Provisional application No. 61/556,953, filed on Nov. 8, 2011.

(51) Int. Cl.

| | |
|---|---|
| ***F04B 17/00*** | (2006.01) |
| ***F04F 5/48*** | (2006.01) |
| ***F04F 5/10*** | (2006.01) |
| ***F04F 10/00*** | (2006.01) |

(52) U.S. Cl.

CPC . *F04B 17/00* (2013.01); *F04F 5/10* (2013.01); *F04F 10/00* (2013.01)

USPC ..... 417/38; 417/187; 417/189

(58) Field of Classification Search

CPC ..... F04D 5/10; F04D 5/48; F04D 10/00; F04B 17/00

USPC ..... 417/38, 39, 182, 187, 189; 251/28

See application file for complete search history.

(56) References Cited

U.S. PATENT DOCUMENTS

| | | | | | |
|---|---|---|---|---|---|
| 1,950,172 | A | * | 3/1934 | Gavaza | 417/181 |
| 3,421,538 | A | * | 1/1969 | Hembree | 137/396 |
| 3,814,543 | A | * | 6/1974 | Gritz | 417/26 |
| 4,056,334 | A | * | 11/1977 | Fortune | 417/189 |
| 4,304,526 | A | * | 12/1981 | Shetler, Sr. | 417/38 |
| 4,482,299 | A | * | 11/1984 | Eulass | 417/54 |
| 4,659,291 | A | * | 4/1987 | Valdes | 417/38 |
| 5,904,333 | A | * | 5/1999 | Kelly et al. | 251/28 |
| 8,032,256 | B1 | * | 10/2011 | Wolf et al. | 700/281 |
| 2010/0045057 | A1 | * | 2/2010 | Tell | 294/64.1 |

* cited by examiner

*Primary Examiner* — Charles Freay

(57) ABSTRACT

A sump water evacuation system that operates automatically without reliance on electricity or floats and without any need for oversight or manual intervention, using domestic water supply as the sole motive force to evacuate sump water either into a washbasin or to the exterior of the building; the system is easily installed for use with Radon remediated sump pits. A pneumatic stagnation pressure automatically signals a rising water level in a sump pit and this signal is communicated to a housing wherein the low-pressure signal is mechanically amplified to activate a tilt valve mechanism, thereby converting the pneumatic signal to a hydraulic force which in turn opens a check valve, allowing a high-pressure domestic water supply to flow through to a commercially available Venturi siphon device, causing the sump water to be suctioned out and expelled into either a washbasin or to the exterior of a building.

7 Claims, 2 Drawing Sheets

AUXILIARY SUMP WATER EVACUATION SYSTEM

CROSS-REFERENCE TO RELATED APPLICATIONS

This application claims the benefit of U.S. Provisional Patent Application 61/556,953, titled "Auxiliary Sump Water Evacuation System", by inventors Lewis Fleischmann and Carle Klupt, filed on Nov. 8, 2011.

BACKGROUND OF THE INVENTION

1. Field of the Invention

The present invention relates to systems that automatically evacuate water from a sump pit, either into a washbasin or to the exterior of a building, by using domestic water as the sole source of motive power. Such a system may be used in conjunction with a standard electric sump pump, or independently, as in the case when electric power is lost. The present inventive sump water evacuation system requires no floats or batteries, can be incorporated in Radon-remediated buildings, and can evacuate water against either zero or positive backpressure.

2. Description of the Related Prior Art

Currently there are devices that will automatically pump water out of a sump pit in the event that electricity to run the pump is lost, or if the primary pump experiences electrical or mechanical failure. One such auxiliary pump employs an on/off switch attached to the pump's float mechanism that energizes a solenoid valve when the water level is higher than normal, thereby allowing domestic water pressure to power a Venturi ejector/eductor pump. However, such a system requires a backup battery system. Another system in the prior art requires the homeowner to be at home during the power outage to connect a commercially available Venturi ejector/eductor pump to a faucet, as well as to position a garden hose into the sump pit, and then to turn on the domestic water faucet for the duration of the flood condition. Once the flood condition subsides, the homeowner must turn off the faucet manually so that water is not unnecessarily wasted. There is yet another sump evacuation pump that is powered solely by water power, but which relies on a float located in the sump pit, mounted slightly higher relative to the float which activates the primary electric sump pump. This float connects by a lever arm to a valve, such as a ball valve, and when the sump water level rises enough will cause the valve to open, thereby allowing faucet water to flow through a Venturi ejector/eductor pump and thereby initiating the sump water evacuation. This system claims to be able to evacuate two gallons of accumulating sump water for every gallon of domestic water throughput. Such systems that rely on floats do not readily lend themselves to incorporation into Radon gas remediated sump pits because the lever arm that penetrates the sump pit cover would have to be fitted with a dynamic seal to ensure gas tight integrity. The present invention overcomes the limitations of the prior art.

SUMMARY OF THE INVENTION

The present automatic sump evacuator system is an assembly comprised of a stagnation pressure activated, fluid-amplified, check-valve device that is coupled to a commercially available Venturi ejector/eductor device, requiring no electric power or manual intervention or oversight for its operation. This assembly screws onto a faucet as may be found in a washbasin in a utility room, or is otherwise connected to any cold water supply pipe having an isolation valve; to allow its operation, the water is turned on. The assembly has three hoses connected to it: a standard garden hose placed into the sump pit for sucking water out of the sump; a very small diameter plastic hose that runs to a rigid stand pipe mounted vertically to a wall of the sump and extending down to within an inch or so from the bottom of the sump pit; and a discharge garden hose or pipe to expel the evacuated sump water either to the building exterior or into a washbasin. The two hoses extending from the assembly into the sump pit are sealed at the sump coverlid to prevent Radon gas from leaking out. These and other features of the present invention will become readily apparent upon further review of the following specifications and drawings and claims.

DETAILED DESCRIPTION OF THE INVENTION

The present invention relates to a sump water evacuation system that automatically turns itself on and off by continuously monitoring the level of water or other liquid in a sump 40 without use of a float device or electricity. It is powered solely by domestic water supply, allowing said water supply to flow when a preset high water level is reached in the sump thereby initiating sump water evacuation, and turning off said water flow when the said preset low water level is reached. This system can be used to augment a standard electric powered sump pump if this standard sump pump is operational, or to operate singly, whether or not the user is present, should the standard pump fail to operate.

Figure 1:
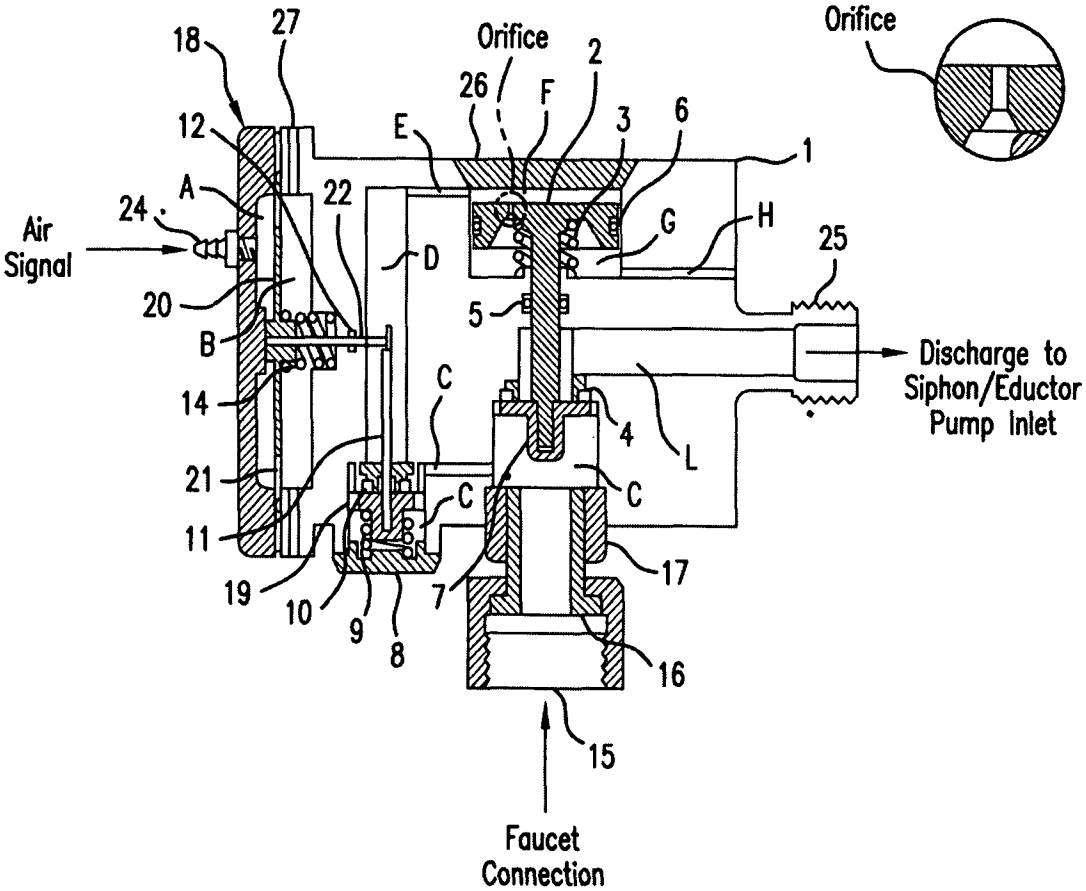
FIG. 1 is a cross-sectional view of the components making up the preferred embodiment of the present assembly; and, FIG. 2 is a plan view of the assembly showing the present assembly connected to a faucet, a Venturi eductor/ejector, a garden hose and the water level sensing standpipe, and installed in a Radon-remediated sump pit.
Figure 2:
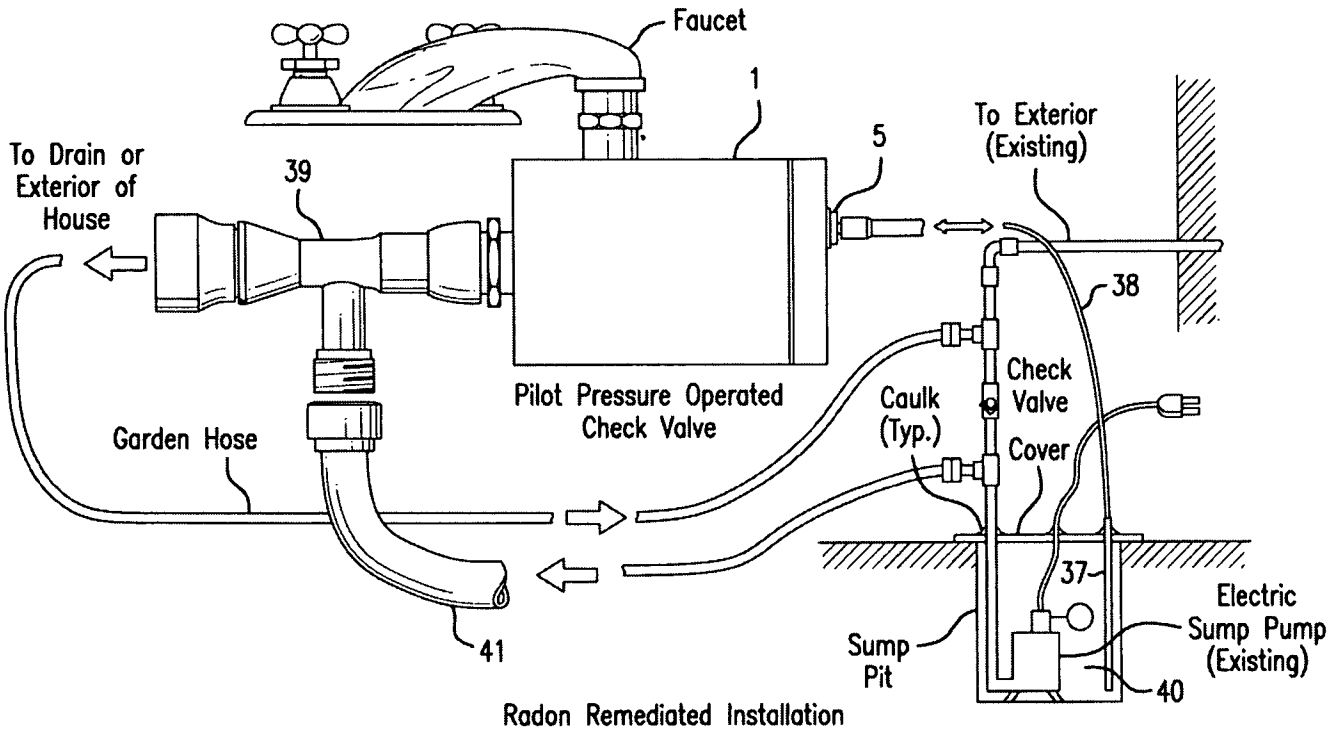

Referring to FIGS. 1 and 2, the main body 1 is comprised of a molded plastic housing that incorporates a barbed fitting 24, which is attached to a capillary tube 38 whose other end is connected to the standpipe 37 vertically located in the sump pit 40. As the water level in the sump rises into the open lower end of the standpipe 37, the pressure of the air within the standpipe 37 increases commensurately and this increasing pressure transmits to chamber A as the signal pressure. This chamber A is defined by an end cap 18 and an elastomeric diaphragm 21 that is sandwiched between the end cap and the housing. A rigid disc 20 lies flat against the diaphragm and has a metallic pushrod 22 press-fitted to the center of the disc. A compression spring 14, located in chamber B maintains the disc 20 in position. As the signal pressure increases, the diaphragm 21 and the disc 20 deflect inward into chamber B thereby forcing the pushrod 22 against a tilt rod 11 that causes the tilt valve 19 to be moved off centerline, allowing relatively high pressure water supplied from a faucet in chamber C to flow past the 'O'-ring seal 10 and into chamber D, through channel E, and into upper piston chamber F above the large diameter piston end 2. Chamber B is always vented to outside ambient air pressure via holes 27. The 'O'-ring 12 is sealed around the rod 22.

As the faucet water supply pressure in upper piston chamber F increases to the maximum faucet supply pressure, the piston is forced downward thereby opening the inlet valve 7, which is seated on the static 'O'-ring 4. Since the area of the large diameter piston end 2 is twice the area of the smaller diameter piston end, the force on the larger piston head 2 is twice that of the smaller piston end at the inlet valve 7. Spring 3 becomes compressed as the piston is forced downward.

A high-lohm small orifice located through the large diameter piston end 2 permits a constant trickle of water from upper piston chamber F to pass through into chamber G and then to the outside ambient via porting channel H. 'O'-ring 5 is a dynamic seal that prevents leakage past the stem of piston. As the piston is forced downward, high-pressure water from the domestic water supply flows past it and enters chamber L. This high-pressure water then flows to the attached commercial Venturi siphon/eductor pump, which creates the suction for water to be siphoned out of the sump pit.

As the water level in the sump recedes, the stagnation pressure signal falls and the pressure in chamber A reduces commensurately. Spring 14 then pushes the diaphragm assembly back to the flat position, retracting rod 22 and allowing pushrod 11 to resume the centerline position. Spring 9 and the high-pressure water in chamber C allow the tilt valve 19 to again seal closed against static 'O'-ring 10, cutting off the high-pressure water flow into upper piston chamber F. Spring 3 and the high-pressure water acting on the piston then push the piston back up. The water trapped in the upper piston chamber F continues to flow out through the orifice into ambient air pressure chamber G and thence out the porting channel H, which turns off the motive high-pressure water flow to the Venturi siphon pump.

Caps 18 and 26 may be ultrasonically welded to the body 1 to create a watertight seal after the internal parts have been placed in position. Fittings 16 and 17 may also be sonically welded into place after the ¾-inch rotatable coupling is assembled as shown. The threads 25 are ¾-inch diameter to adapt to a commercial Venturi siphon pump. This stagnation pressure signal activated apparatus will cycle on and off as required to keep the sump from overflowing and uses domestic water supply only when needed. The present inventive device works automatically without the need for human attention or oversight.

The present assembly is a system for evacuating a liquid from a sump pit to a remote location, powered solely by a domestic water pressure in response to a stagnation pressure signal. The present assembly comprises a housing containing a diaphragm chamber, comprising chambers A and B, in which is located the diaphragm assembly 20 and 21, which is responsive to the stagnation pressure signal. A pushrod 22 attaches to the diaphragm assembly and protrudes through a dynamic plunger seal 12 into the tilt rod chamber D of the tilt valve 19. The tilt valve 19 includes a tilt rod 11 that is juxtaposed against the pushrod 22 such that mechanical lever arm moment amplification is induced when the pushrod 22 is caused to move by the diaphragm assembly.

The motive domestic water supply enters via an inlet fluid channel C, which is separated in an initial closed condition from the tilt rod chamber D by the tilt valve 19.

There is a check valve assembly comprised of a piston assembly having a large diameter piston end 2, and a small diameter piston end, as well as a piston shaft connecting both piston ends. A dynamic seal 5 is located on this piston shaft between the large diameter piston end 2 and the discharge fluid chamber L.

The stagnation pressure signal is created in the vertical stagnation pressure standpipe 37 mounted in the sump pit 40 which is in pneumatic continuity with chamber A of the diaphragm housing by means of a non-distensible Polyurethane small diameter tubing 38. Ultimately, it is this stagnation pressure signal, induced by a rising sump water level, that controls the means for the operation of the motive domestic water flow.

The diaphragm chamber has diametric dimensions that impart to the diaphragm assembly—the elastomeric diaphragm 21 along with the centrally placed disc 20—a flat conformation under the initial zero differential pressure conditions. The diaphragm assembly constitutes a preferred means to amplify the force of the stagnation pressure signal. The diaphragm chamber must have on the biasing spring side of the diaphragm assembly at least one vent port 27 open to ambient atmospheric pressure so as to avoid compressing the air and increasing the pressure in chamber B when the diaphragm assembly 20, 21 is pushed in that direction, by venting air from chamber B.

There is a biasing spring 14 located on pushrod 22 within the biasing spring side of the diaphragm in chamber B, which exerts a force on the diaphragm assembly 20, 21 slightly greater than the static friction force induced by the pushrod 22 sealing means. The pushrod 22 is fitted with a dynamic plunger seal 12 having a minimal cross-sectional area.

As seen in FIG. 1, in the initial closed condition the tilt rod chamber D is sealably isolated by the tilt valve 19 from the inlet fluid chamber C which as has been noted is in fluidic connection with a domestic water pressure.

The tilt valve 19 has a tilt rod 11 within the tilt rod chamber D that mechanically amplifies the stagnation pressure signal by a summation of moments and overcomes thereby a high-pressure hydraulic force as the tilt valve 19 is moved to an open position. In this way, the tilt valve 19 controls the flow of domestic high-pressure fluid entering via the high-pressure inlet chamber C and which then flows into the upper piston chamber F located above the large diameter piston end 2 of the check valve assembly.

The check valve assembly must also have a high-lohm orifice to vent residual fluid out of upper piston chamber F when the pump system is automatically turning off. In the preferred embodiment, this orifice is located through the large diameter piston end 2 allowing a restricted fluid flow to an ambient air pressure chamber G located on the opposite side of the large diameter piston end; ambient air pressure chamber G is in fluidic continuity with an ambient atmospheric pressure by a porting channel H. It is nonetheless within the scope and contemplation of this invention for the high-lohm vent to communicate to ambient air by any other functionally equivalent means, such as through the housing itself.

Discharge fluid chamber L is fluidically isolated between the large diameter piston end 2 and the inlet valve 7, and comprises the system's outflow track in fluidic communication with a commercially available Venturi ejector/eductor pump, such as with a screw-on adaptor 25.

In another preferred embodiment, there is a piston head dynamic seal 6, which circumferentially seals the large diameter piston end 2, and which may be replaced with an elastomeric rolling diaphragm.

Referring now to FIG. 2, a standpipe 37 is fixedly positioned in sump pit 40 such that the open end of the pipe is located at the same level as the highest position of the existing pump's float travel. In the situation that the existing pump does not function, the accumulating water level in the sump will keep rising.

As rising water enters the lower open end of the standpipe 37, the standpipe pressure increases because the air within the closed space of the standpipe 37 and its communicating air chamber A becomes compressed. A barbed fitting 24 attached to the top of the standpipe 37 connects to a corresponding fitting of the same size at signal input 24 on the end cap 18 of the housing 1 wherein the air space of the standpipe 37 and capillary tube 38 is in free communication with chamber A on one side of the diaphragm chamber. A small—for example 1/16-inch—diameter capillary tube 38 of Polyurethane or like material is used to join the two barbed fittings.

For example, should the water level rise 4 inches above the bottom of the standpipe's open end, the air pressure with the standpipe 37 and capillary tubing would increase by a pressure of 0.144 psig. As illustrated in FIG. 1, this increased air pressure, the stagnation pressure signal, is transmitted into chamber A through capillary tube 38 connected at the barbed fitting 24. Referring to FIG. 1, a diaphragm assembly, comprised of an elastomeric diaphragm 21 and a rigid disc 20 fixed in its center is sandwiched between chambers A and B. For example, if said diaphragm assembly has an exposed diameter of 2 inches then in this exemplary embodiment it has an exposed area equal to 3.14 square inches. A pressure of 0.144-psig acting on a diaphragm surface with this area creates a force of 0.452 pounds pushing the diaphragm assembly toward chamber B, which thereby compresses biasing spring 14 to move a pushrod 22 against a tilt lever 11 located in the long-stem chamber D.

The 'O'-ring 12 functions as a dynamic seal between air chamber B and water chamber D, thereby separating the pneumatic and hydraulic parts of the present assembly. The long-stem tilt lever 11 is press-fitted into the tilt valve 19 forming thereby an integral assembly. The tilt valve 19 sits flush against the 'O'-ring 10, being biased in the closed position both by spring 9 and by the 60-psig pressure throughout chambers C; chambers C communicate with the domestic water supply at the faucet connection formed by parts 15, 16, and 17 as illustrated in FIG. 1.

Since the length of the long-stem of the tilt lever 11 from the pushrod 22 is much greater than the distance from the centerline of tilt lever 11 to the radius of 'O' ring 10, the summation of moments, which is to say the force developed to move the tilt valve away from the 'O' ring 10, is thereby significantly amplified. The tilt valve opens and thereby permits the high-pressure 60-psig water to flow into chamber D, through channel E, and then into chamber F to act on the large diameter piston head 2.

If the diameter of the large diameter piston end 2 is, in an exemplary embodiment, 2 inches, then the area of this end of the piston is 3.14 square inches. When 60-psig pressure acts on an area of 3.14 square inches there develops a total force of 188 pounds. Now if the smaller piston end of the inlet valve 7 has an area one-half of that of the large diameter piston end 2 contained within the area bounded by 'O' ring 4, then this same pressure of 60 psig will exert a closing force of one-half of 188 pounds, or 94 pounds. Thus, in this example, there is differential force of 94 pounds moving the piston 2 downward and thereby forcing the check valve into an open position. 'O' ring 5 forms a dynamic seal between chamber G and the discharge fluid chamber L.

A high-lohm orifice of about 0.012-inch diameter is formed through the larger diameter end of piston 2 and permits a trickle of water to flow from chamber F into chamber G. The pressure in ambient air pressure chamber G is the same as the outside ambient air pressure since ambient air pressure chamber G communicates with the outside through porting channel H. The differential force exerted between upper piston chamber F and chamber C is sufficiently large to open inlet valve 7, permitting high-pressure 60-psig water to flow through the discharge fluid chamber L and into an attached commercial Venturi siphon device.

In a further adaptive embodiment, a hose connector baffle, screws onto the housing 1 to allow the apparatus to be mounted to a washbasin faucet so the sump water can be discharged into the washbasin. Alternatively, should a user wish to exhaust the sump water to the exterior of the building an ordinary 3/4-inch garden hose can be run to the exterior of the dwelling as shown in FIG. 2. A simple impedance attachment is available if the commercial Venturi siphon device needs backpressure to function.

While the invention has been described in detail with reference to the preferred embodiment, it should be appreciated that the present invention is not limited to that precise embodiment. Rather, in view of the present disclosure that describes the best mode for practicing the invention, many modifications and variations would present themselves to those skilled in the art without departing from the scope and spirit of this invention, as defined in the following claims.

What is being claimed is:

1. A system for evacuating a liquid from a sump pit to a remote location, powered solely by a domestic water pressure in response to a stagnation pressure signal, comprising:

a. a housing comprising a diaphragm chamber having a diaphragm assembly responsive to said stagnation pressure signal; and, b. a pushrod connected to said diaphragm assembly and sealably protruding into a tilt rod chamber; and, c. a tilt valve located in said tilt rod chamber and further comprised of a tilt valve rod juxtaposed against said pushrod; and, d. an inlet fluid chamber fluidly separated in an initial closed condition from the tilt rod chamber by said tilt valve; and, e. a check valve assembly comprised of a piston chamber having a large diameter piston end, and a small diameter piston end, and a piston shaft connecting said piston ends, wherein the check valve assembly also comprises a dynamic seal between an ambient pressure chamber and a discharge fluid chamber; and, f. a stagnation pressure standpipe, vertically located in the sump pit and in pneumatic continuity with said diaphragm housing, within which said stagnation pressure signal is generated that controls an operation of a motive flow of said domestic water pressure.

2. The system as recited in claim 1 wherein the diaphragm chamber has diametric dimensions that impart to the diaphragm and the diaphragm assembly a flat conformation under an initial zero differential pressure condition, and further comprising on a pushrod side of said diaphragm chamber at least one vent port open to said ambient atmospheric pressure.

3. The system as recited in claim 2 further comprising a biasing spring located on the pushrod side of said diaphragm chamber which exerts a force on said diaphragm assembly slightly greater than a static friction force induced by a plunger seal of said pushrod having a small cross-sectional area.

4. The system as recited in claim 1 wherein said tilt rod chamber is in the initial closed condition sealably isolated by the tilt valve from the inlet fluid chamber which is in fluidic connection with said domestic water pressure; and further comprising, a. the tilt rod of said tilt valve, located within the tilt rod chamber, which mechanically amplifies said stagnation pressure signal by a summation of moments which overcomes thereby a high-pressure hydraulic force; and, b. wherein said tilt valve controls a flow of said domestic water pressure entering into an upper piston chamber that houses said large diameter piston end of said check valve.

5. The check valve assembly as recited in claim 1 further comprising a high-lohm orifice located through a large diameter piston end allowing a restricted fluid flow to a sub-piston head chamber located on an opposite side of said large diameter piston end; wherein said sub-piston head chamber is in fluidic continuity with said ambient atmospheric pressure by a sub-piston porting channel.

6. The system as recited in claim 1 wherein the discharge fluid chamber in fluidic communication with a Venturi ejector/eductor pump connecting port.

7. The system as recited in claim 1 further comprising a piston head dynamic 'O'-ring, which circumferentially seals said large diameter piston end.

* * * * *